US010999680B2

(12) United States Patent
Farkas et al.

(10) Patent No.: US 10,999,680 B2
(45) Date of Patent: May 4, 2021

(54) ELECTRODYNAMIC ACOUSTIC TRANSDUCER WITH IMPROVED WIRING

(71) Applicants: AAC TECHNOLOGIES PTE. LTD., Singapore (SG); AAC TECHNOLOGIES (NANJING) CO., LTD., Nanjing (CN)

(72) Inventors: Coloman Farkas, Vienna (AT); Friedrich Reining, Vienna (AT)

(73) Assignees: AAC TECHNOLOGIES PTE. LTD., Singapore (SG); AAC TECHNOLOGIES (NANJING) CO., LTD., Nanjing (CN)

( * ) Notice: Subject to any disclaimer, the term of this patent is extended or adjusted under 35 U.S.C. 154(b) by 0 days.

(21) Appl. No.: 15/978,804

(22) Filed: May 14, 2018

(65) Prior Publication Data

US 2018/0332402 A1 Nov. 15, 2018

(30) Foreign Application Priority Data

May 15, 2017 (AT) ..... A50410/2017

(51) Int. Cl.

| | |
|---|---|
| ***H04R 9/06*** | (2006.01) |
| ***H04R 1/06*** | (2006.01) |
| ***H04R 9/02*** | (2006.01) |
| ***H04R 9/04*** | (2006.01) |

(52) U.S. Cl.

CPC ..... *H04R 9/06* (2013.01); *H04R 1/06* (2013.01); *H04R 9/025* (2013.01); *H04R 9/046* (2013.01); *H04R 9/063* (2013.01); *H04R 9/045* (2013.01)

(58) Field of Classification Search

CPC ..... H04R 2209/041

USPC ..... 381/401, 117, 400

See application file for complete search history.

(56) References Cited

U.S. PATENT DOCUMENTS

| | | | | |
|---|---|---|---|---|
| 2,640,964 | A * | 6/1953 | Freedman | H03C 3/28 332/129 |
| 2003/0174856 | A1 | 9/2003 | Johannsen et al. | |
| 2005/0078848 | A1 * | 4/2005 | Hlibowicki | H04R 9/02 381/401 |
| 2008/0044044 | A1 * | 2/2008 | Madaffari | H04R 9/025 381/186 |

(Continued)

FOREIGN PATENT DOCUMENTS

| | | | |
|---|---|---|---|
| CN | 202435594 | U | 9/2012 |
| JP | 2010268032 | A | 11/2010 |

(Continued)

OTHER PUBLICATIONS

First Office Action for counterpart Austrian patent application No. A50410/2017, dated May 8, 2018.

*Primary Examiner* — Alexander Krzystan

(57) ABSTRACT

An electrodynamic acoustic transducer (1*a* . . . 1*e*) is presented, which comprises a housing (2), a membrane (3), a coil arrangement (6, 6*a* . . . 6*h*) attached to the membrane (3) and a magnet system (9, 10, 11). The coil arrangement (6, 6*a* . . . 6*h*) comprises a plurality of coils (7, 8) each having two terminals (T7*a*, T7*b*, T8*a*, T8*b*, T9*a*, T9*b*) being static in relation to the housing (2). Connecting wires (12*a*, 12*b*, 13*a*, 13*b*) connect the coils (7, 8) and the terminals (T7*a*, T7*b*, T8*a*, T8*b*, T9*a*, T9*b*, T78*b*). The connecting points (C7*a*, C7*b*, C8*a*, C8*b*) between the connecting wires (12*a*, 12*b*, 13*a*, 13*b*) and the coils (7, 8) are symmetrically arranged on the coil arrangement (6, 6*a* . . . 6*h*).

20 Claims, 7 Drawing Sheets

(56) References Cited

U.S. PATENT DOCUMENTS

| | | | | |
|---|---|---|---|---|
| 2010/0104116 | A1* | 4/2010 | Liou | H04R 19/013 381/191 |
| 2010/0203918 | A1 | 8/2010 | Watanabe | |
| 2011/0274309 | A1 | 11/2011 | Doh et al. | |
| 2012/0257784 | A1 | 10/2012 | Tang | |
| 2014/0321690 | A1 | 10/2014 | Reining | |
| 2015/0172818 | A1* | 6/2015 | Gladwin | H04R 3/12 381/337 |
| 2016/0007121 | A1* | 1/2016 | Hung | H04R 9/046 381/401 |
| 2016/0198264 | A1* | 7/2016 | Guo | H04R 9/02 381/398 |
| 2016/0212546 | A1* | 7/2016 | Salvatti | H04R 9/06 |

FOREIGN PATENT DOCUMENTS

| | | | |
|---|---|---|---|
| TW | 201603598 | A | 1/2016 |
| WO | 2009063557 | A1 | 5/2009 |

* cited by examiner

ELECTRODYNAMIC ACOUSTIC TRANSDUCER WITH IMPROVED WIRING

CROSS-REFERENCE TO RELATED APPLICATIONS

This application claims priority to Austrian Patent Application No. A50410/2017, filed on May 15, 2017, which is hereby incorporated by reference in its entirety.

BACKGROUND OF THE INVENTION

The invention relates to an electrodynamic acoustic transducer, which comprises a housing, a membrane and a coil arrangement attached to the membrane, wherein the coil arrangement comprises a plurality of coils each having two terminals being static in relation to the housing. Furthermore, the transducer comprises a magnet system being designed to generate a magnetic field transverse to a longitudinal direction of a wound wire of the coil arrangement. Finally, the transducer comprises connecting wires connecting the coils and the terminals.

An electrodynamic acoustic transducer of the kind above generally is known. In this context US 2014/321690 A1 discloses a speaker with two coils stacked above another.

A drawback of prior art transducers is that an electric signal is not just transformed in a desired piston-like movement of the membrane, but also leads to a rocking movement respectively tumbling movement of the membrane caused by undesired but unavoidable asymmetries of the speaker. One parameter, which influences the rocking/tumbling movement is the length of the connecting wires. Usually, the connecting wires are comparably long and often shaped like a loop so as to provide a low spring constant, thus keeping the influence of the connecting wires on the rocking/tumbling movement of the membrane low. Although said influence may be reduced in the presented way, it does not disappear.

SUMMARY OF THE INVENTION

Accordingly, it is an object of the invention to overcome the drawbacks of the prior art and to provide an improved electrodynamic acoustic transducer. Particularly, a rocking/tumbling movement of the membrane shall be avoided or at least reduced in comparison to prior art transducer designs.

The inventive problem is solved by a transducer as defined in the opening paragraph, wherein the connecting points between the connecting wires and the coils are symmetrically arranged on the coil arrangement.

In this way, the influence of the connecting wires on the rocking/tumbling movement of the membrane is practically zero. Forces acting on the membrane caused by the connections wires are symmetric and do not cause a rocking/tumbling movement of the membrane.

Further details and advantages of an audio transducer of the disclosed kind will become apparent in the following description and the accompanying drawings.

In particular, the connecting points between the connecting wires and the coils are symmetrically arranged on the coil arrangement:

a) seen in a direction perpendicular to a plane encompassed by a wound wire respectively by a wire loop and/or;

b) with respect to a height extension perpendicular to a plane encompassed by a wound wire respectively by a wire loop.

In case a) the coil arrangement is viewed in the direction of a loop axis respectively in a direction, in which the wound wire appears as a loop or as loops. In this view, the connecting points between the connecting wires and the coils are symmetrically arranged around the coil arrangement. This is a first approach of symmetry of the connecting points.

The "loop axis" is perpendicular to a plane encompassed by the wound wire respectively a wire loop. In other words, the loop axis is the axis, around which the coil has to be rotated to wind the coil.

In case b) the connecting points are beneficially arranged in the same plane (which is encompassed by the wound wire respectively a wire loop of the coil arrangement) and in particular in the mid of a height extension of the coil arrangement. However, the connecting points may also be arranged in different planes or at different heights to obtain symmetry. For example, a first pair of two connection points may be arranged opposite to each other on a first height or level, whereas a second pair of two connection points may be arranged opposite to each other on a second height or level. This case b) is a second approach of symmetry of the connecting points, which can be used alone or in combination with the first approach (case a) of symmetry.

Generally, mounting the coils to each other may be done by means of an adhesive or glue. Beneficially, connecting points may be arranged in a bonding plane of two coils, in particular in case of an even number of coils comprised by the coil arrangement. In this way, manufacturing the coil arrangement is comparably easy. In case of an even number of coils (e.g. two coils), the connecting points may be arranged in the mid of a height extension of the coil arrangement.

Particularly, the coil arrangement can comprise coils (in particular two coils), which are identical in shape and which are mounted to each other head first. Using identical coils allows for manufacturing the coil arrangement in a very economic way. Because the coils are mounted to each other head first, symmetry with regards to the height extension of the coil arrangement can be obtained easily.

Beneficially, also the terminals are symmetrically arranged around the coil arrangement thus further improving the performance of the transducer by avoiding rocking/tumbling of the membrane. Similar to the connection points also the terminals can be symmetrically arranged a) seen in a direction perpendicular to a plane encompassed by a wound wire respectively by a wire loop and/or b) with respect to a height extension perpendicular to a plane encompassed by a wound wire respectively by a wire loop.

To even further improve the performance of the transducer, the connecting wires may be symmetrically arranged around the coil arrangement and/or may be substantially identical in shape.

Generally, the coil arrangement may have the shape of a polygon (e.g. of a rectangle or a square) or may be round (e.g. oval or even circular). Moreover, the coil arrangement may comprise two or more coils. The coils of the coil arrangement can be wound in the same direction or in opposite directions.

Beneficially, two coils (or each two coils of more than two coils) have one terminal in common. Accordingly, a series connection of the coils is obtained. In this context, two connecting wires may connect the coils and the common terminal in an advantageous embodiment of the transducer. Such a design particularly applies to rectangular and square coil arrangements and generally polygons with an even number of sides. The reason is that the number auf connecting wires is even, too. However, in an alternative advantageous embodiment, a single connecting wire connects the coils and the common terminal. Such a design particularly applies to circular coil arrangements and generally polygons with an odd number of sides.

In an advantageous embodiment of the electrodynamic acoustic transducer, a spider is connected to the coil arrangement, wherein:

connecting wires connecting the coils and the terminals are attached to said spider and/or, a conductive layer or path electrically connecting the coils and the common terminal is attached to said spider.

A spider fixes respectively centers the coil arrangement. In this embodiment, the spider (particularly its arms) is used to carry the connecting wires and/or a conductive path or layer. Hence, the connecting wires are limited in their movement, and so their tendency for vibrations is reduced.

It should be noted at this point that the term "wire" does not necessarily imply a circular cross section, but also comprises "flat" and in particular rectangular cross sections. Especially in the context of the spider it is beneficial to use flat cross sections so as to allow a largely unhindered vertical movement of the coil arrangement and thus of the membrane, but to hinder a lateral movement due to the high aspect ratio of the spider arms or legs. This directional property results from the different moduli of mechanical resistance (vertical versus horizontal). In this context, one should also note that a connecting wire with a rectangular cross section being fixed to the spider may also be seen as a conductive path on a substrate. Accordingly, the border to the conductive layer or path on a spider is blurred.

However, the conductive layer or path beneficially comprises or consists of a conductive adhesive attached to the spider, whereas the connecting wires are beneficially made of copper. Nevertheless, also the conductive layer or path may be made of copper in one embodiment.

Usually, the connecting wires turn into the coils at the connecting points in an uncut manner. In one embodiment, a wire with circular cross section is used to wind the coils, which wire is flattened in the region between the connecting points and the terminals, e.g. by means of pressing. In this way, advantageous mechanical properties (e.g. low bending resistance) are combined with advantageous electrical properties (low transition resistance).

In yet another beneficial embodiment, a conductive layer or path attached to the membrane electrically connects the coils and the common terminal. Alternatively or in addition, a conductive layer or path electrically connecting the coils and the common terminal may be attached to a spider as disclosed above.

In particular, the conductive layer or path comprises or consists of a conductive adhesive attached to the membrane/spider. In this embodiment, advantage is taken of the fact that comparably high currents (e.g. caused by an audio signal) can flow from a first coil to a second coil via the common connection point arranged on the moving part of the speaker, and just comparably low currents (e.g. for controlling tasks) flow out of or into the common terminal. For this reason, a dedicated connecting wire from the common connection point to the common terminal can be omitted. Instead, a conductive layer or path on the membrane/spider is used for this reason. However, a short piece of wire may be used to connect the common connecting point between the coils with the conductive layer or path. Said wire particularly may be a section of the coil wire of one of the coils or both coils at the common connecting point. Both coils may be electrically connected directly at the conductive layer or path or at a distance from the conductive layer or path. Accordingly, in the latter case, a separate, short piece of wire, a short section of the coil wire of one of the coils or short sections of the coil wires of both coils may connect the common connecting point with the conductive layer or path.

To obtain mechanical symmetry, additional conductive paths may be attached to the membrane/spider, which are not necessarily desired from an electrical point of view, because a particular electrical connection is already realized by another path. Those additional conductive paths may be (superfluously) connected to the coil arrangement or not.

In particular, the resistance of the conductive layer or path is higher than the real value of the impedance of each of the coils, which the conductive layer or path is connected to. Accordingly, the conductive layer or path can be made comparably thin thus hardly deteriorating the membrane characteristics/spider characteristics.

Using a conductive layer or path is of particular advantage in cases where an odd/even number of terminals is needed for a polygon-shaped coil with an even/odd number of corners/sides. An illustrative example is a rectangular or square coil arrangement with three terminals. According to this embodiment of the disclosed transducer, symmetry can be obtained with two symmetrically arranged connecting wires for two terminals and a conductive layer for the third terminal. As disclosed above, connecting wires are preferably connected to the outer terminals of the series connection of the coils, and the conductive layer is connected to the common connection point of the connected coils.

In yet another beneficial embodiment of the proposed transducer, multiple connecting wires connect a polygonal coil arrangement at its corners. For example, this embodiment provides perfect symmetry for rectangular coil arrangements. In view of polygonal coil designs, the magnet system often comprises a number of separate, rod-shaped magnets (respectively magnets shaped like a cuboid) instead of a single ring-shaped magnet. Accordingly, the magnetic field is concentrated on the longitudinal sides of the polygon and is relatively weak in its corners. That is the reason why a connection wire in the corner has nearly no influence on the performance of the transducer. As said, this particularly counts for a magnet system with rod-shaped magnets, but—of course in an alleviated way—also for ring-shaped magnets. Alternatively, multiple connecting wires may connect the coil arrangement at the center of its longitudinal sides what leads to perfect symmetry as well.

One should note that the above embodiments may be used in any desired combination or variation, in particular if the coil arrangement comprises more than two coils and a plurality of common terminals.

BRIEF DESCRIPTION OF THE DRAWINGS

These and other aspects, features, details, utilities, and advantages of the invention will become more fully apparent from the following detailed description, appended claims, and accompanying drawings, wherein the drawings illustrate features in accordance with exemplary embodiments of the invention, and wherein:

Like reference numbers refer to like or equivalent parts in the several views.

DETAILED DESCRIPTION OF EMBODIMENTS

Figure 1:
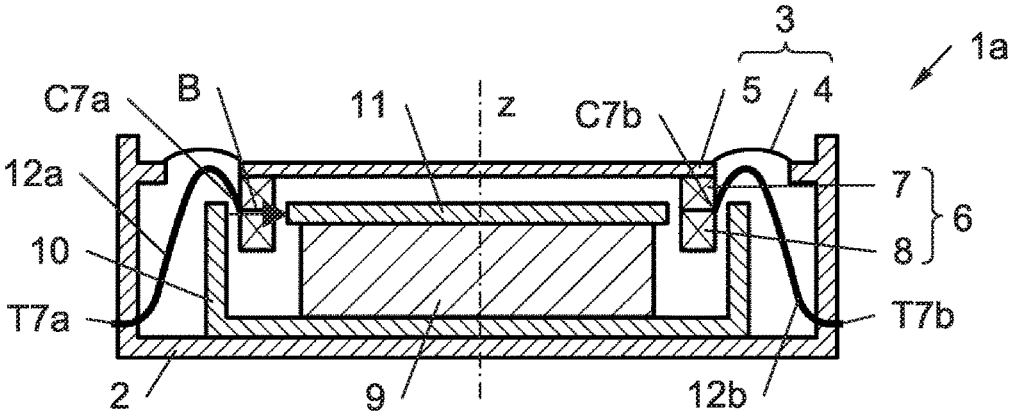
FIG. 1 shows a cross sectional view of an exemplary transducer.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

All directional references (e.g., "plus", "minus", "upper", "lower", "upward", "downward", "left", "right", "leftward", "rightward", "front", "rear", "top", "bottom", "over", "under", "above", "below", "vertical", "horizontal", "clockwise", and "counterclockwise") are only used for identification purposes to aid the reader's understanding of the present disclosure, and do not create limitations, particularly as to the position, orientation, or use of the any aspect of the disclosure. It is to be understood that the terms so used are interchangeable under appropriate circumstances such that the embodiments of the invention described herein are, for example, capable of operation in other orientations than those illustrated or otherwise described herein.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., "attached", "coupled", "connected", and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

All numbers expressing measurements and so forth used in the specification and claims are to be understood as being modified in all instances by the term "about", which particularly means a deviation of ±10% from a reference value.

FIG. 1 shows an example of an electrodynamic acoustic transducer 1*a*, which may be embodied as a loudspeaker, in cross sectional view. The transducer 1*a* comprises a housing 2 and a membrane 3 with a bending section 4 and a center section 5 stiffened by a plate. Furthermore, the transducer 1*a* comprises a coil arrangement 6 attached to the membrane 3. The coil arrangement 6 comprises a first coil 7 and a second coil 8. The first coil 7 is arranged on top of the second coil 8 and concentric to the second coil 8 in this example.

Generally, mounting the coils 7, 8 to each other may be done by means of an adhesive or glue.

Furthermore, the transducer 1*a* comprises a magnet system with a magnet 9, a pot plate 10 and a top plate 11. The magnet system generates a magnetic field B transverse to a longitudinal direction of a wound wire of the coil arrangement 6.

Figure 2:
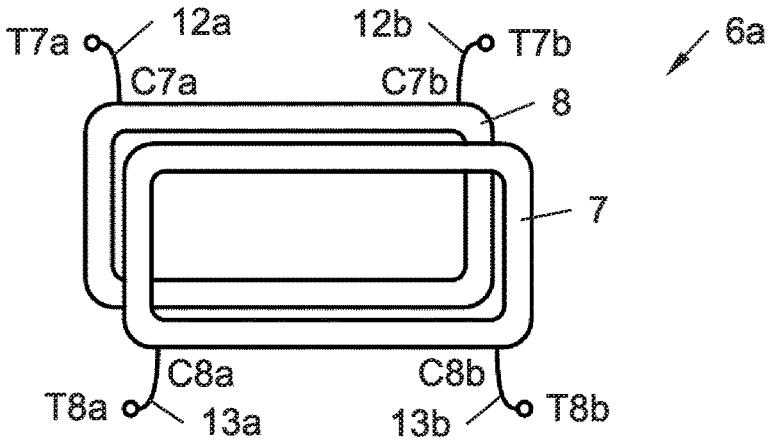
FIG. 2 shows a first example of a coil arrangement with the coil connections in adjacent corners in exploded view.
Figure 3:
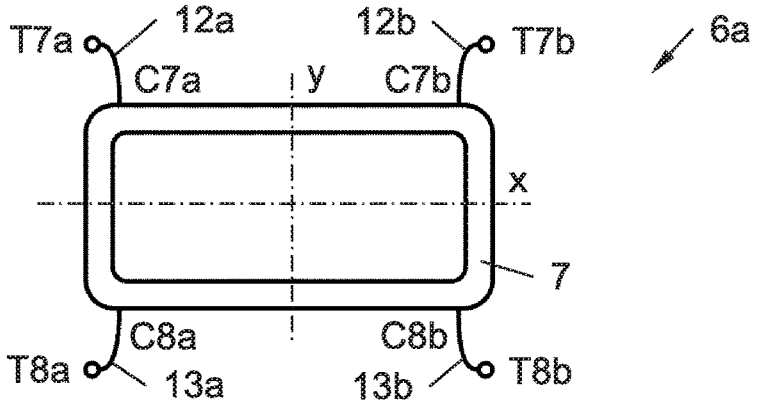
FIG. 3 shows a top view of the coil arrangement of FIG. 2 in operating position.

FIGS. 2 and 3 show a top view of a first embodiment of a coil arrangement 6*a*. FIG. 2 shows an exploded view with the coils 7, 8 displaced in diagonal direction, and FIG. 3 shows the coil arrangement 6*a* in operating position arranged above another.

The first coil 7 has two terminals T7*a*, T7*b* being static in relation to the housing 2. Similarly, the second coil 8 has two terminals T8*a*, T8*b* being static in relation to the housing 2. A connecting wire 12*a* connects the terminal T7*a* and the first coil 7 at a connecting point C7*a*, a connecting wire 12*b* connects the terminal T7*b* and the first coil 7 at a connecting point C7*b*, a connecting wire 13*a* connects the terminal T8*a* and the second coil 8 at a connecting point C8*a*, and a connecting wire 13*b* connects the terminal T8*b* and the second coil 8 at a connecting point C8*b*.

The connecting points C7*a*, C7*b*, C8*a*, C8*b* are symmetrically arranged around the coil arrangement 6*a*, in particular with respect to the main axes x and y of the rectangular coil arrangement 6*a*.

In a preferred embodiment, also the terminals T7*a*, T7*b*, T8*a*, T8*b* are symmetrically arranged around the coil arrangement 6*a* as is shown in FIG. 3 (again with respect to the main axes x and y, respectively seen in a direction perpendicular to a plane encompassed by a wound wire respectively by a wire loop—case a). Furthermore, it is advantageous if also the connecting wires 12*a*, 12*b*, 13*a*, 13*b* are symmetrically arranged around the coil arrangement 6*a* (again with respect to the main axes x and y) as shown in FIG. 3. Finally, it is also advantageous, if the connecting wires 12*a*, 12*b*, 13*a*, 13*b* are substantially identical in shape as this is the case in FIG. 3.

Generally, the connecting points C7*a*, C7*b*, C8*a*, C8*b* between the connecting wires 12*a*, 12*b*, 13*a*, 13*b* and the coils 7, 8 may be symmetrically arranged on the coil arrangement 6 seen in the loop axis z respectively in a direction perpendicular to a plane encompassed by a wound wire respectively by a wire loop (case a). In this view, the wound wires of the coils 7, 8 appear as loops. This first approach of symmetry was discussed above.

However, alternatively or in addition a second approach of symmetry of the connecting points C7*a*, C7*b*, C8*a*, C8*b* may be applied to the transducer 1*a*. According to this approach, the connecting points C7*a*, C7*b*, C8*a*, C8*b* between the connecting wires 12*a*, 12*b*, 13*a*, 13*b* and the coils 7, 8 are symmetrically arranged on the coil arrangement 6 with respect to a height extension perpendicular to a plane encompassed by a wound wire respectively by a wire loop (case b). In particular, the connecting points C7*a*, C7*b*, C8*a*, C8*b* may be arranged in the mid of a height extension of the coil arrangement 6 as this is the case in FIG. 1. The height extension of the coil arrangement 6 is oriented vertically in FIG. 1.

However, arranging the connection points C7*a*, C7*b*, C8*a*, C8*b* in the mid of a height extension of the coil arrangement 6 is no necessary condition. The connecting points C7*a*, C7*b*, C8*a*, C8*b* may also be arranged in different planes or at different heights. For example, a first pair of two connection points C7*a*, C8*b* may be arranged opposite to each other on a first height or level, whereas a second pair of two connection points C7*b*, C8*a* may be arranged opposite to each other on a second height or level.

The very same counts for the terminals T7*a*, T7*b*, T8*a*, T8*b*, which may be arranged symmetrically with respect to a height extension perpendicular to a plane encompassed by a wound wire respectively by a wire loop (case b) as this is the case in the example of FIG. 1. The terminals T7*a*, T7*b*, T8*a*, T8*b* may also be arranged in different planes or at different heights. For example, a first pair of two terminals T7*a*, T8*b* may be arranged opposite to each other on a first height or level, whereas a second pair of two terminals T7*b*, T8*a* may be arranged opposite to each other on a second height or level.

It should be noted that the connecting points C7*a*, C7*b*, the connecting wires 12*a*, 12*b* and the terminals T7*a*, T7 in FIG. 1 are shown in the cutting plane for better understanding, whereas in the top views of FIGS. 2 and 3 the connecting wires 12*a*, 12*b* run in other directions.

The connecting points C7*a*, C7*b*, C8*a*, C8*b* beneficially may be arranged in a bonding plane of two coils 7, 8, which is the case in the example shown in FIGS. 1 to 3. In this way, manufacturing the coil arrangement is comparably easy.

In a very advantageous embodiment, the coil arrangement 6 comprises (two) coils 7, 8, which are identical in shape and which are mounted to each other head first. Using identical coils allows for manufacturing the coil arrangement 6 in a very economic way. Because the coils 7, 8 are mounted to each other head first, symmetry with regards to the height extension of the coil arrangement 6 is obtained in a very easy way.

Figure 4:
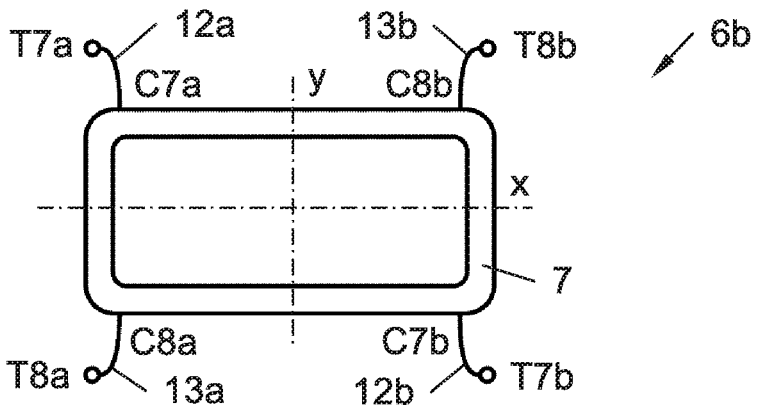
FIG. 4 shows a second example of a coil arrangement with the coil connections in opposite corners in top view.

FIG. 4 shows an embodiment of another coil arrangement 6*b*, which is quite similar to the coil arrangement 6*a* shown in FIGS. 2 and 3. In contrast, the terminals T7*a*, T7*b*, the connection points C7*a*, C7*b* and the connecting wires 12*a*, 12*b* are not arranged at adjacent corners on the longer side of the rectangular coil 7, but at diagonal corners. The same counts for the second coil 8.

Figure 5:
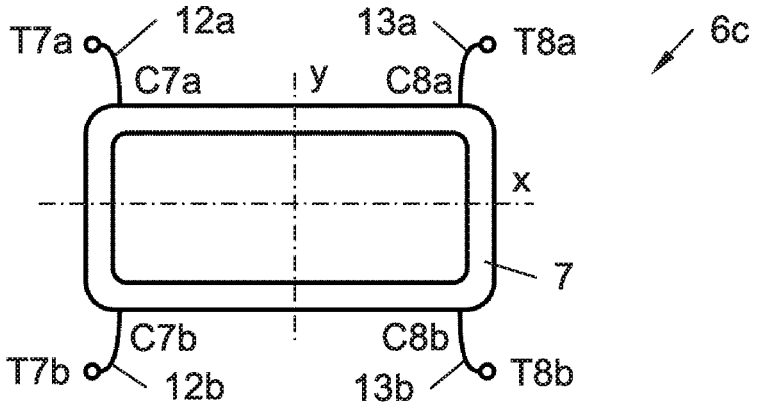
FIG. 5 like FIG. 2, but with the coil connections in adjacent corners on the short side of the rectangular coil arrangement.

FIG. 5 shows an embodiment of another coil arrangement 6*c*, which is quite similar to the coil arrangement 6*a* shown in FIGS. 2 and 3. In contrast, the terminals T7*a*, T7*b*, the connection points C7*a*, C7*b* and the connecting wires 12*a*, 12*b* are not arranged at adjacent corners on the longer side of the rectangular coil 7, but at adjacent corners on the shorter side. The same counts for the second coil 8.

In view of polygonal coil designs, often a number of separate, rod-shaped magnets 9 (respectively magnets 9 shaped like a cuboid) instead of a single ring-shaped magnet 9 are used. Accordingly, the magnetic field is concentrated on the longitudinal sides of the polygon and is relatively weak in its corners. That is the reason why an individual connection point C7*a*, C7*b*, C8*a*, C8*b* in a corner of the polygon has nearly no influence on the performance of the transducer 1*a*.

Figure 6:
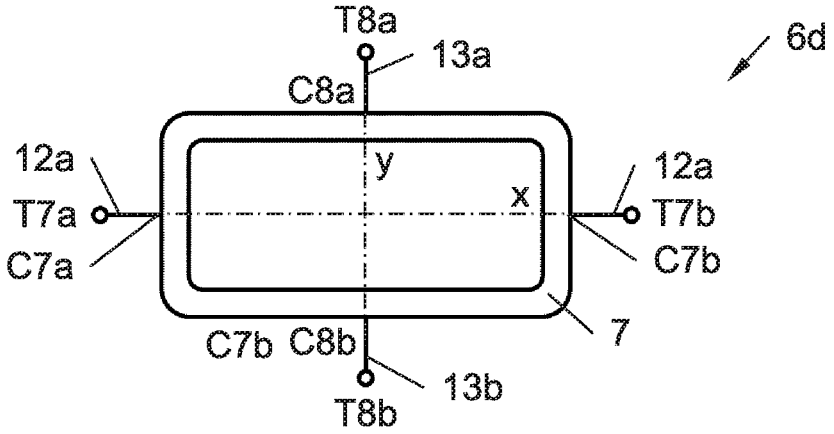
FIG. 6 shows a further example of a coil arrangement with the coil connections on the longitudinal sides of the rectangular coil arrangement.

FIGS. 3 to 5 show arrangements, where the connecting wires 12*a*, 12*b*, 13*a*, 13*b* connect the coil arrangement 6*a* . . . 6*c* at its corners. However, this is not the only alternative. FIG. 6 shows a coil arrangement 6*d* with the terminals T7*a*, T7*b*, T8*a*, T8*b*, the connection points C7*a*, C7*b*, C8*a*, C8*b* and the connecting wires 12*a*, 12*b*, 13*a*, 13*b* at the center of the longitudinal sides of the coil arrangement 6*d*.

In FIG. 6, the terminals T7*a*, T7*b*, the connection points C7*a*, C7*b* and the connecting wires 12*a*, 12*b* are arranged on the shorter side and the terminals T8*a*, T8*b*, the connection points C8*a*, C8*b* and the connecting wires 13*a*, 13*b* are arranged on the longer side of the rectangular coil 7. However, in an alternative embodiment the terminals T7*a*, T7*b*, the connection points C7*a*, C7*b* and the connecting wires 12*a*, 12*b* may be arranged on another side of the rectangular coil 7. Similarly, this counts for the second coil 8 in an equivalent way.

Figure 7:
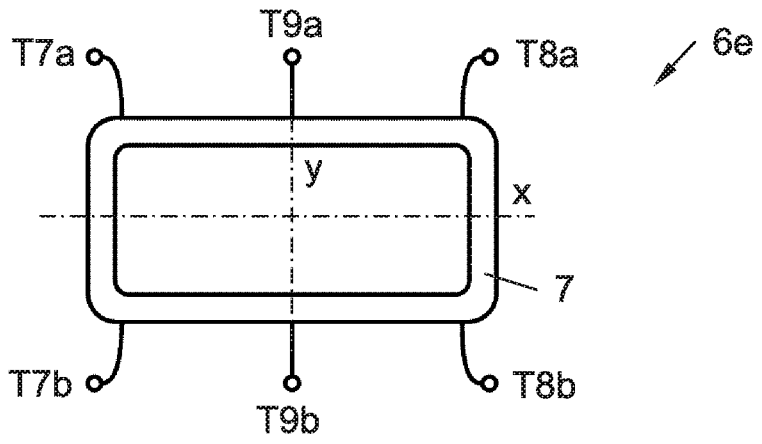
FIG. 7 shows an example of a coil arrangement with three rectangular coils.

In FIGS. 1 to 6, the coil arrangements 6 . . . 6*d* comprises two coils 7, 8. However, the coil arrangement 6 may also comprise more than two coils 7, 8. FIG. 7 shows an example of a coil arrangement 6*e* with three coils and thus six terminals T7*a*, T7*b*, T8*a*, T8*b*, T9*a*, T9*b*. The coil arrangement 6*e* is just exemplary, and the position of the terminals T7*a*, T7*b*, T8*a*, T8*b*, T9*a*, T9*b* may be amended in different ways without departing from the inventive spirit.

Figure 8:
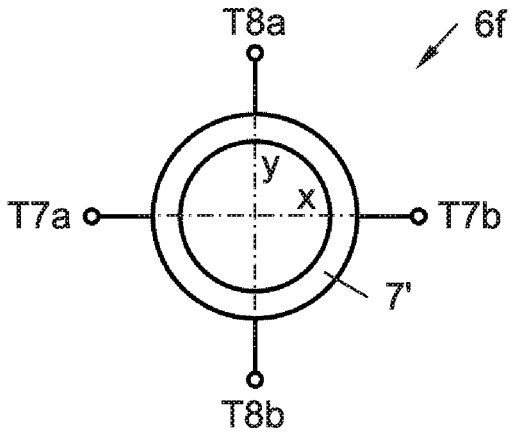
FIG. 8 shows an example of a circular coil arrangement.

In FIGS. 1 to 7, the coil arrangements 6 . . . 6*e* respectively their coils 7, 8 are rectangular in shape. However, this is not the only possibility. A coil arrangement may also be quadratic in shape or round for example. FIG. 8 shows an example of a circular coil arrangement 6*f*. The terminals T7*a* and T7*b* of the first coil 7' are arranged opposite to each other in FIG. 8. However, the terminals T7*a* and T7*b* may also be arranged adjacent to each other. The same counts for the second coil.

In FIGS. 1 to 8, the terminals T7*a*, T7*b*, T8*a*, T8*b*, T9*a*, T9*b* of the coil arrangements 6 . . . 6*f* can be connected in any desired way. However, often the coils 7, 8 have to be switched in series. In this case two connecting points C7*a*, C7*b*, C8*a*, C8*b* of different coils 7, 8 are electrically connected.

Figure 9:
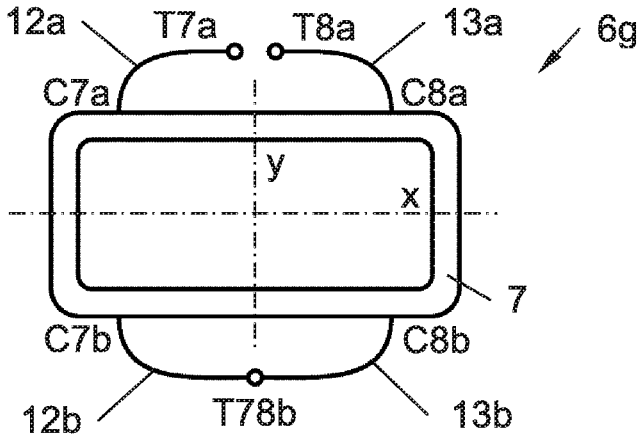
FIG. 9 shows an example with two connecting wires connecting the coils to a common terminal.

In this context, FIG. 9 shows a first example of a coil arrangement 6*g*, which is quite similar to the coil arrangement 6*a* shown in FIGS. 2 and 3. In contrast the connecting points C7*b* and C8*b* of the coils 7, 8 are electrically connected. Accordingly, the coils 7, 8 have one terminal T78*b* in common. The electrical connection of the connecting points C7*b* and C8*b* can be done by connecting the connecting wires 12*b* and 13*b* at the (static) terminal T78*b*. Additionally, the electrical connection of the connecting points C7*b* and C8*b* can be done directly at the moving coils 7, 8. Beneficially, the connection at the moving coils 7, 8 can be made with low ohmic resistance, so that the connecting wires 12*b* and 13*b* can be made relatively thin and with comparably high ohmic resistance without substantially affecting the low ohmic serial connection of the coils 7, 8.

Figure 10:
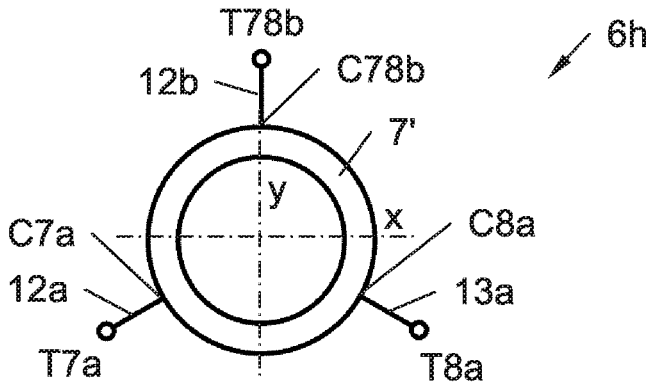
FIG. 10 shows an example with a single connecting wire connecting the coils to a common terminal.

In FIG. 9, two connecting wires 12*b*, 13*b* connect the coils 7, 8 and the common terminal T78*b*. However, this is not the only possibility. FIG. 10 shows an alternative embodiment of a coil arrangement 6*h*, which is quite similar to the coil arrangement 6*f* shown in FIG. 8. In contrast, again two coils 7, 8 are switched in series. But now a single connecting wire 12*b* connects the coils 7, 8 and the common terminal T78*b*. Accordingly, the common connecting point C78*b* of the coils 7, 8 is arranged on the moving coil arrangement 6*h*.

Figure 11:
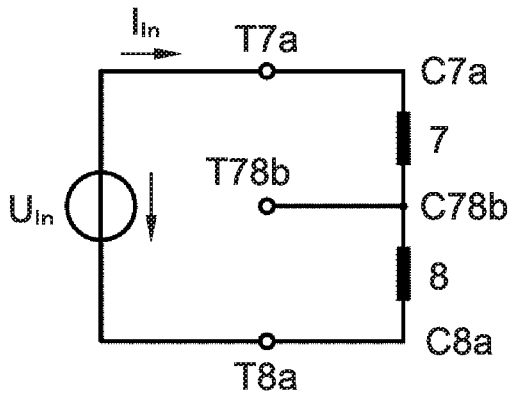
FIG. 11 shows a simplified circuit diagram of the transducer shown in FIG. 10.

FIG. 11 shows a simplified circuit diagram of the coil arrangements 6*h* shown in FIG. 10. Concretely, FIG. 11 shows a voltage source, generating the voltage $U_{In}$, which is fed to a serial connection of the first coil 7 and the second coil 8. In common designs, the voltage $U_{In}$, forms a sound signal, and a current $I_{In}$ caused by the voltage $U_{In}$, which flows into the terminal T7*a* and out of the terminal T8*a*, T7*b*, is comparably high. In contrast, currents flowing out of or into the common terminal T78*b*, which are used for controlling tasks for example, are comparably low.

Figure 12:
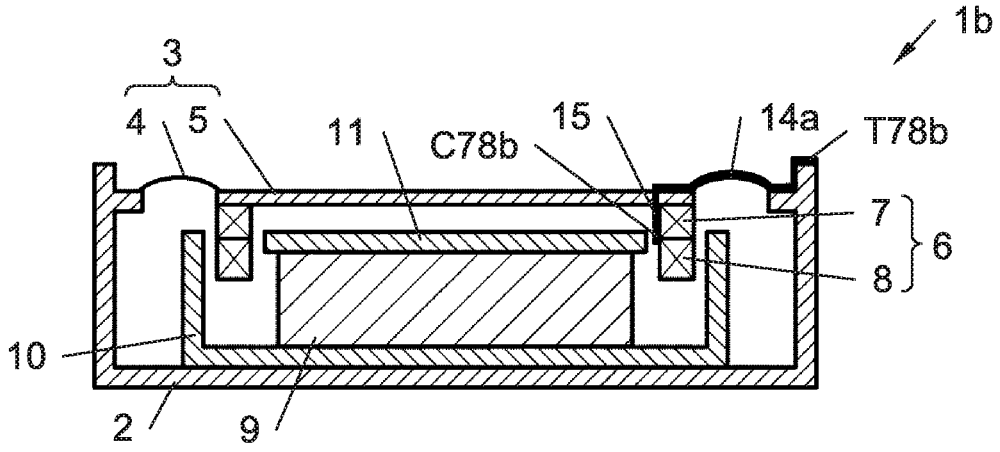
FIG. 12 shows a cross sectional view of an exemplary transducer with a conductive path on the membrane.

For this reason, a dedicated connecting wire 12*b* from connecting point C78*b* to the common terminal T78*b* can be omitted. Instead, a conductive path 14*a*, which is attached to the membrane 3 and which is electrically connected to the common connecting point C78*b* of the coils 7, 8, is used for this reason as this is shown in FIG. 12, which depicts a cross sectional view of an exemplary transducer 1*b*, and FIG. 13, which depicts a top view of the transducer 1*b* of FIG. 12.

Concretely, a short piece of wire 15 (which may be a short section of a coil wire of one of the coils 7, 8 or both coils 7, 8) connects the common connecting point C78*b* of the coils 7, 8 and the conductive path 14*a*. On the outer, fixed part of the membrane 3 respectively conductive path 14*a*, the common terminal T78*b* is arranged. The conductive path 14*a* comprises or consists of a conductive adhesive attached to the membrane 3.

Such a design is of particular advantage in cases where an odd/even number of terminals T7*a*, T7*b*, T8*a*, T8*b*, T9*a*, T9*b*, T78*b* is needed for a polygon-shaped coil arrangement 6 with an even/odd number of corners/sides. An illustrative example for this is shown in FIG. 9. Here a rectangular coil arrangement 6*g* has three terminals T7*a*, T8*a*, T78*b*.

Figure 14:
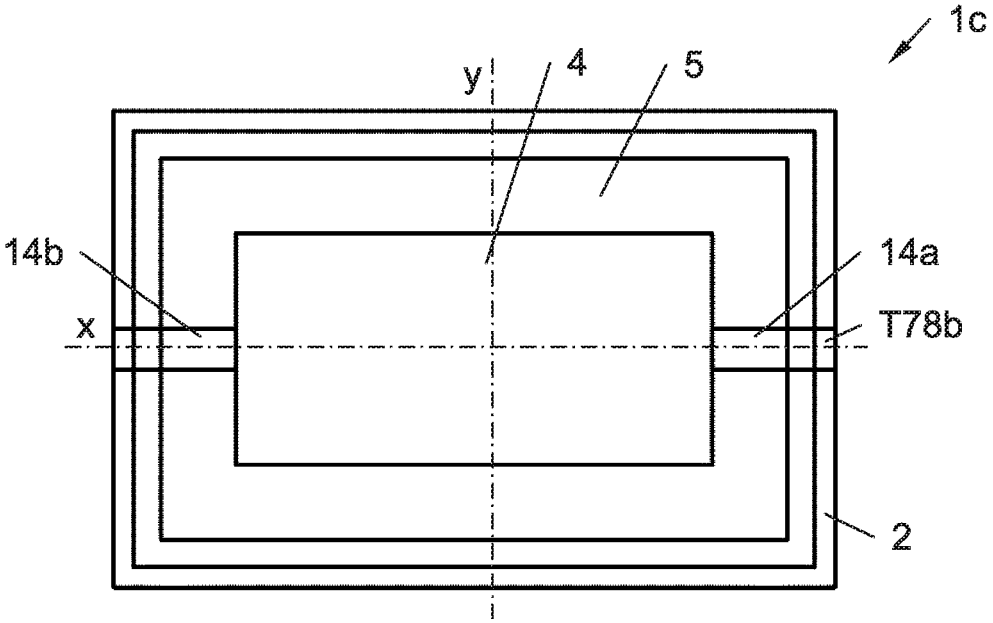
FIG. 14 shows a further example of a transducer with improved symmetry.

Symmetry can be obtained with two symmetrically arranged connecting wires 12*a*, 13*a* for the two outer terminals T7*a*, T8*a* and the conductive path 14*a* for the common terminal T78*b* as the conductive path 14*a* has nearly no influence on a rocking or tumbling tendency of the coil arrangement 6. For example, the connecting points C7*a*, C8*a* and also the terminals T7*a*, T8*a* may be arranged on the x-axis or on the y-axis or at opposite corners. To further improve symmetry, a second conductive path 14*b* may be arranged vis-a-vis of the first conductive path 14*a* as this is shown for the transducer 1*c* in FIG. 14. This additional conductive path 14*b* is not desired from an electrical point of view, but improves the mechanical and acoustic properties of the transducer 1*c*. The second conductive path 14*b* may be electrically connected to the coils 7, 8 or not. Another possibility to improve symmetry is to attach a conductive layer to the whole membrane 3 or to attach a conductive layer with symmetric shape to the membrane 3.

Figure 15:
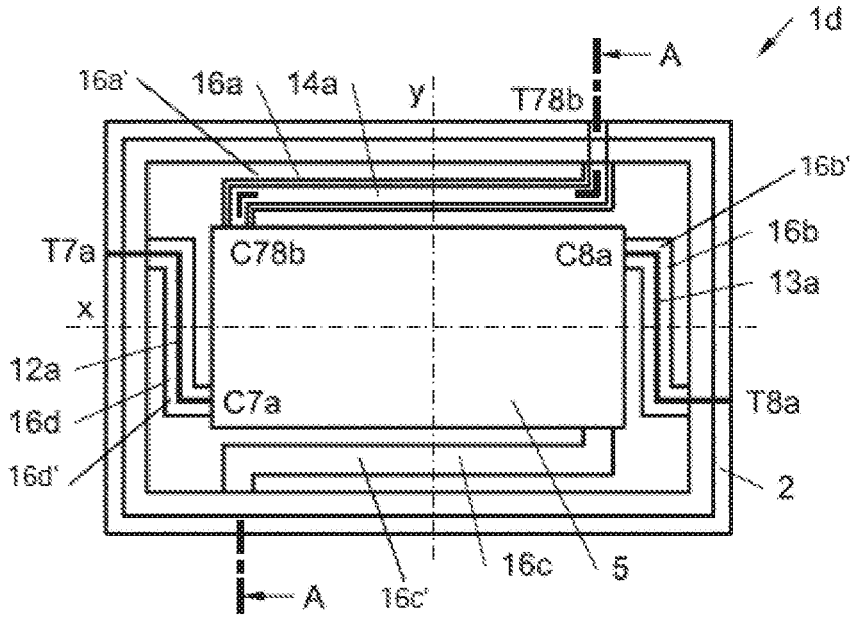
FIG. 15 shows a first example of a transducer with a spider with wires and a conductive path arranged on the spider in top view.
Figure 16:
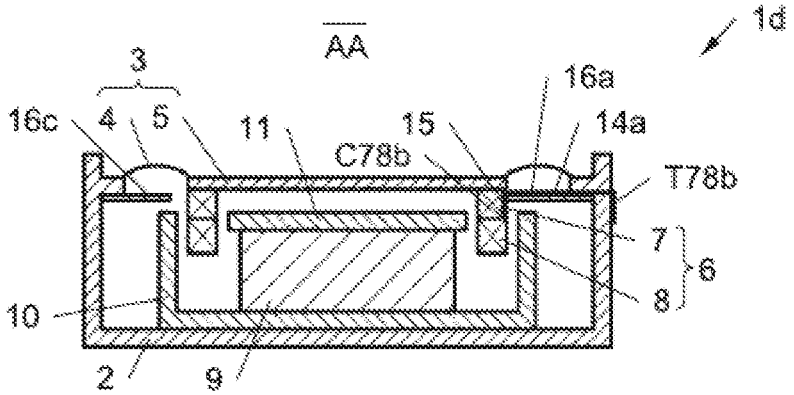
FIG. 16 shows a cross sectional view of the transducer of FIG. 14.

FIGS. 15 and 16 show a first example of a transducer 1*d* with a spider 16*a* . . . 16*d*. FIG. 15 shows the transducer 1*d* in top view, wherein the bending section 4 of the membrane 3 is removed to provide a view into the interior of the transducer 1*d*. FIG. 16 shows the transducer 1*d* in cross sectional view AA. The electrodynamic acoustic transducer 1*d* comprises a spider 16*a* . . . 16*d*, which is connected to the coil arrangement 6. Concretely, the spider comprises four spider arms 16*a*' . . . 16*d*' each of which is arranged on the longitudinal edge of the rectangular coil arrangement 6.

In this example, a connecting wire 12*a*, which connects the connecting point C7*a* with the terminal T7*a*, is attached to the spider arm 16*d*, and a connecting wire 13*a*, which connects the connecting point C8*a* with the terminal T8*a*, is attached to the spider arm 16*b*. Furthermore, a conductive layer or path 14*a*, which connects the coils 7, 8 and the common terminal T78*b*, is attached to the spider arm 16*a*.

Figure 13:
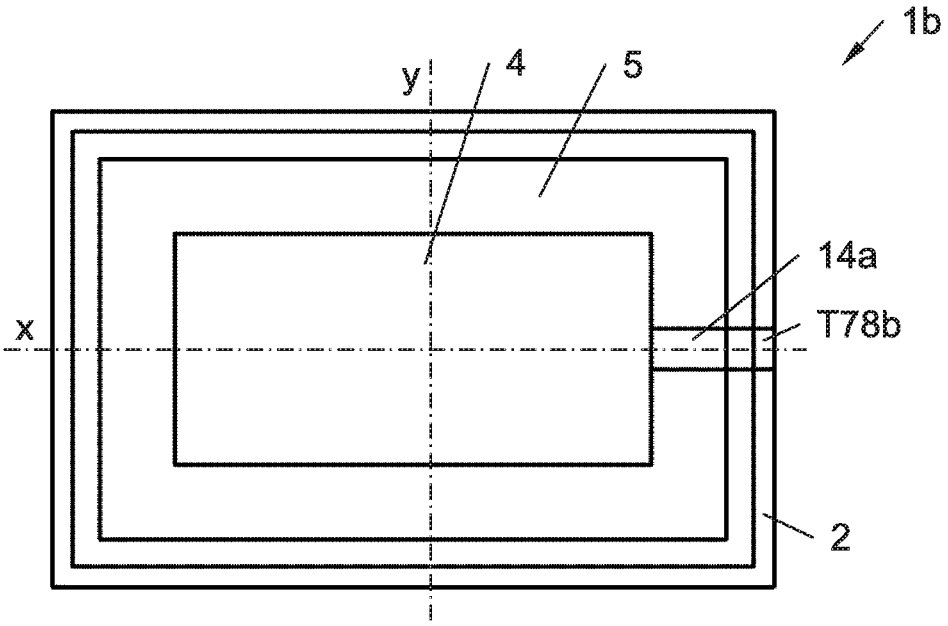
FIG. 13 shows the transducer of FIG. 12 in top view.

The electrical structure of the transducer 1*d* is comparable to the embodiments shown in FIGS. 11, 12 and 13. Mechanically, the transducer 1*d* is a bit different as the spider 16*a* . . . 16*d* fixes respectively centers the coil arrangement 6. The spider arms are 16*a*' . . . 16*d*' symmetrically arranged around the coil arrangement 6 and so are the connecting wires 12*a*, 13*a*. The connecting wires 12*a*, 13*a* are limited in their movement, and so their tendency for vibrations is reduced.

It should be noted at this point that the term "wire" does not necessarily imply a circular cross section, but also comprises "flat" and in particular rectangular cross sections. Especially in the context of the spider 16*a* . . . 16*d* it is beneficial to use flat cross sections so as to allow a largely unhindered vertical movement of the coil arrangement 6 and thus of the center section 5 of the membrane 3. In this context, one should also note that a connecting wire 12*a*, 13*a* with rectangular cross section being fixed to the spider 16*a* . . . 16*d* may also be seen as a conductive path on a substrate, which is the spider arm 16*a* . . . 16*d* here. Accordingly, the border to the conductive layer or path 14*a*, which is fixed to the spider arm 16*a* as well, is blurred. However, the conductive layer or path 14*a* beneficially comprises or consists of a conductive adhesive attached to the spider arm 16*a*, whereas the connecting wires 12*a*, 13*a* are beneficially made of copper. Nevertheless, also the conductive layer or path 14*a* may be made of copper in one embodiment.

Usually, the connecting wires 12*a*, 13*a* turn into the coils 7, 8 at the connecting points C7*a*, C8*a* in an uncut manner. In one embodiment, a wire with circular cross section is used to wind the coils 7, 8, which wire is flattened in the region between the connecting points C7*a*, C8*a* and the terminals T7*a*, T8*a*, e.g. by means of pressing. In this way, advantageous mechanical properties (e.g. low bending resistance) are combined with advantageous electrical properties (low transition resistance).

To obtain perfect symmetry, also the spider arm 16*c* may be equipped with an additional conductive path, which may be connected to the common connecting point C78*b* or not. This additional conductive path is not desired from an electrical point of view, but improves the mechanical and acoustic properties of the transducer 1*d* (see also FIG. 14 in this context).

Figure 17:
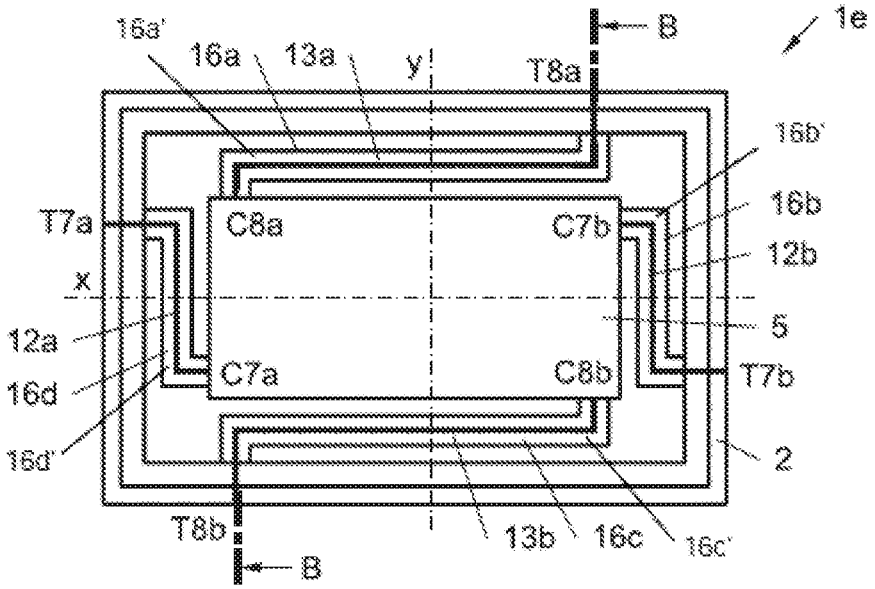
FIG. 17 shows a second example of a transducer with a spider with wires arranged on the spider in top view and FIG. 18 shows a cross sectional view of the transducer of FIG. 16.
Figure 18:
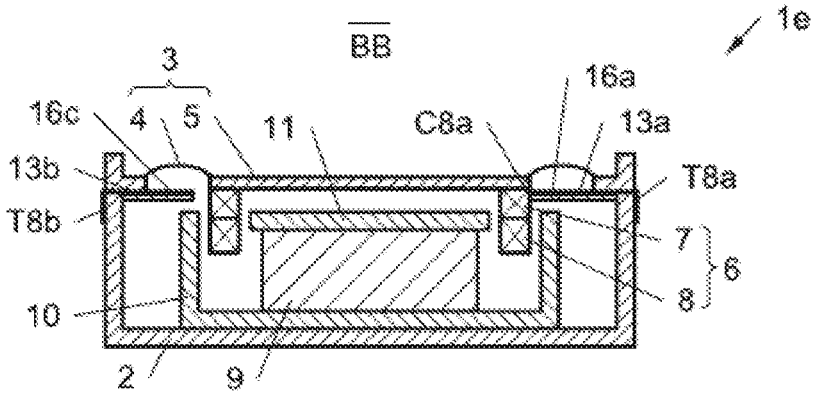

FIGS. 17 and 18 show a further example of a transducer 1*e* with a spider 16*a* . . . 16*d*. FIG. 17 shows the transducer 1*e* in top view, wherein the bending section 4 of the membrane 3 again is removed, and FIG. 18 shows the transducer 1*e* in cross sectional view BB. The transducer 1*e* is similar to the transducer 1*d* shown in FIGS. 15 and 16. In contrast, four connecting wires 12*a*, 12*b*, 13*a*, 13*b*, which connect the connecting points C7*a*, C7*b*, C8*a*, C8*b* with the terminals T7*a*, T7*b*, T8*a*, T8*b*, are arranged on the spider arms 16*a*' . . . 16*d*'. Electrically, the transducer 1*e* is similar to the embodiments shown in FIGS. 1 to 6 and 8, mechanically the transducer 1*e* is similar to the transducer 1*d* of FIGS. 15 and 16.

One should note that the embodiments shown in the Figures shall just illustrate the possibilities, and variations of different kind may be envisaged by a skilled in the art.

One should also note that the presented embodiments may be used in any useful combination. For example, arranging connecting wires 12*a*, 13*a* on the spider arms 16*a*', 16*c*' may be combined with a conductive layer or path 14*a* arranged on the membrane 3 (see FIGS. 12 to 14). Furthermore, free hanging connecting wires 12*a*, 12*a* (see FIG. 1) may be combined with connecting wires 12*a*, 13*a* on the spider arms 16*a*', 16*c*' and/or with a conductive layer or path 14*a* arranged on a spider arm 16*c*. Moreover, conductive layers or paths 14*a* on a spider arm 16*c* may be combined with conductive layers or paths 14*a* on the membrane 3.

In the example above, the transducer 1*b* . . . 1*e* comprises just one common connecting point C78*b*, one common terminal T78*b* and one conductive path or layer 14*a* and an optional conductive path 14*b*. Nevertheless, further common connecting points may be electrically connected to further terminals by further conductive paths or layers. Different paths may be arranged side by side, whereas different layers may be arranged on top of each other as the case may be.

It should be noted that although the examples depicted in the FIGS. 1 to 18 disclose circular and rectangular coil arrangements 6*a* . . . 6*h*, the invention relates to any shape of a coil arrangement, in particular also to oval and polygonal shapes. Furthermore, the coils 7 and 8 may have the same height or different heights, the same diameter or different diameters as well as the same number of windings or different numbers of windings. Beneficially a coil arrangement is symmetric with regards to the two main axes x and y.

It should also be noted, that the coils 7, 8 may be wound in the same directions or in opposite directions.

Furthermore, the invention does not just relate to two or three coils 7, 8, but to any number of coils.

Additionally, it should be noted that although symmetric design of connecting points C7*a*, C7*b*, C8*a*, C8*b*, terminals T7*a*, T7*b*, T8*a*, T8*b*, T9*a*, T9*b*, T78*b* and connecting wires 12*a*, 12*b*, 13*a*, 13*b* is advantageous, one may also deviate from a strict symmetric design without departing from the inventive spirit. For example, the terminals T7*a*, T7*b*, T8*a*, T8*b*, T9*a*, T9*b*, T78*b* may be arranged in a different manner to provide a particular electrical interface. Furthermore, the shape of the connecting wires 12*a*, 12*b*, 13*a*, 13*b* may be different. Nevertheless, the influence of the connecting wires 12*a*, 12*b*, 13*a*, 13*b* on the movement of the membrane 3 may still be substantially symmetric by choosing an adequate design.

As was disclosed hereinbefore, it is of advantage to have the wires 12*a*, 13*a*, 12*b*, 13*b* respectively the individual connection points C7*a*, C7*b*, C8*a*, C8*b* in the corners of a polygonal coil arrangement 6*a* . . . 6*e*. Basically the same counts for the conductive paths 14*a*, 14*b*, which are advantageously arranged in said corners as well. Generally, the effect of the magnetic stray field on the wires 12*a*, 13*a*, 12*b*, 13*b* is different than on the conductive paths 14*a*, 14*b* because of the different current levels and/or impedances. On the one hand, different current levels lead to different forces acting on the membrane 3 caused by the different currents flowing through the wires 12*a*, 13*a*, 12*b*, 13*b* respectively through the conductive paths 14*a*, 14*b*. On the other hand, different voltages are induced into the wires 12*a*, 13*a*, 12*b*, 13*b* respectively into the conductive paths 14*a*, 14*b* based on their different impedances. Since the strayfield is lower in the corner regions, as said it is beneficial to use these corner regions for any of the connection types between the coils 7,8 and the non-moving parts of the transducer 1*a* . . . 1*c*, i.e. for the wires 12*a*, 13*a*, 12*b*, 13*b* and/or the conductive paths 14*a*, 14*b*. Moreover, it is easier to connect the wires 12, 13, 12*a*, 13*a*, 12*b*, 13*b* respectively the conductive paths 14*a*, 14*b* in a region, where no magnets 9 are, for mechanical reasons.

It should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application. Although numerous embodiments of this invention have been described above with a certain degree of particularity, those skilled in the art could make numerous alterations to the disclosed embodiments without departing from the spirit or scope of this disclosure.

LIST OF REFERENCES

1*a* . . . 1*e* electrodynamic acoustic transducer
2 housing
3 membrane
4 bending section
5 stiffened center section
6, 6*a* . . . 6*h* coil arrangement
7 first coil
8 second coil
9 magnet
10 pot plate
11 top plate
12*a* . . . 13*b* connecting wire
14*a*, 14*b* conductive path
15 wire
16*a* . . . 16*d* spider (arms)
B magnetic field
C7*a* . . . C8*b* connecting point
T7*a* . . . T9*b* terminal
x first main axis
y second main axis
z third main axis/loop axis
$U_{In}$ input voltage
$I_{In}$ input current

What is claimed is:

1. An electrodynamic acoustic transducer, comprising:
a housing;
a membrane;
a coil arrangement attached to the membrane, the coil arrangement comprising:
a first coil attached to the membrane and having two connecting points;
a second coil concentrically arranged to the first coil and having two connecting points; a bottom of the first coil directly attached to a top of the second coil by means of an adhesive along a vibration direction of the membrane;
connecting wires attached to each of the connecting points; and
terminals on each of the connecting wires opposite the connecting points, the terminals being static in relation to the housing; and
a magnet system disposed in the housing and configured to generate a magnetic field transverse to a longitudinal direction of a wound wire of the coil arrangement,
wherein the connecting points are arranged symmetrically around the central axis of the plurality of coils;
the first coil does not overlap the second coil in a direction perpendicular to the vibration direction and is arranged between the membrane and the second coil.

2. The electrodynamic acoustic transducer as claimed in claim 1, wherein the connecting points are further symmetrically arranged on the coil arrangement with respect to a height extension perpendicular to a plane encompassed by a wound wire respectively by a wire loop.

3. The electrodynamic acoustic transducer as claimed in claim 1, wherein the terminals are symmetrically arranged around the central axis of the first coil and the second coil.

4. The electrodynamic acoustic transducer as claimed in claim 1, wherein the connecting wires are symmetrically arranged around the central axis of the first coil and the second coil.

5. The electrodynamic acoustic transducer in claim 1, wherein the connecting wires are substantially identical in shape.

6. The electrodynamic acoustic transducer in claim 1, wherein the connecting points are arranged in a bonding plane of the first coil and the second coil.

7. The electrodynamic acoustic transducer as claimed in claim 1, wherein the first coil and the second coil have one terminal in common.

8. The electrodynamic acoustic transducer as claimed in claim 7, wherein the coil arrangement comprises more than two coils and a plurality of common terminals.

9. The electrodynamic acoustic transducer as claimed in claim 7, wherein two connecting wires connect the coils and the common terminal.

10. The electrodynamic acoustic transducer as claimed in claim 7, wherein a single connecting wire connects the coils and the common terminal.

11. The electrodynamic acoustic transducer as claimed in claim 7, wherein a conductive layer or path attached to the membrane electrically connects the coils and the common terminal.

12. The electrodynamic acoustic transducer as claimed in claim 11, wherein the conductive layer or path comprises or consists of a conductive adhesive attached to the membrane.

13. The electrodynamic acoustic transducer as claimed in claim 7, wherein a spider being connected to the coil arrangement, wherein connecting wires connecting the coils and the terminals are attached to said spider and/or, a conductive layer or path electrically connecting the coils and the common terminal is attached to said spider.

14. The electrodynamic acoustic transducer as claimed in claim 13, wherein the conductive layer or path comprises or consists of a conductive adhesive attached to the spider.

15. The electrodynamic acoustic transducer as claimed in claim 1, wherein the first coil and the second coil are wound in opposite directions.

16. The electrodynamic acoustic transducer as claimed in claim 1, wherein the coil arrangement comprises coils, which are identical in shape and which are mounted to each other head first.

17. The electrodynamic acoustic transducer as claimed in claim 1, wherein the first coil and the second coil are polygonal in shape.

18. The electrodynamic acoustic transducer as claimed in claim 1, wherein the first coil and the second coil are round, in particular circular, in shape.

19. An electrodynamic acoustic transducer, comprising:
a housing;
a membrane;
a coil arrangement attached to the membrane, the coil arrangement comprising:
a first coil attached to the membrane and having two connecting points;
a second coil concentrically arranged to the first coil and having two connecting points; a bottom of the first coil directly attached to a top of the second coil by means of an adhesive along a vibration direction of the membrane;
wherein each connecting point is located on a longitudinal side and substantially near a corner of its respective coil;
connecting wires attached to each of the connecting points; and
terminals on each of the connecting wires, the terminals being static in relation to the housing and located at an end of the connecting wires opposite the connecting points;

a magnet system disposed in the housing and configured to generate a magnetic field transverse to a longitudinal direction of a wound wire of the coil arrangement, wherein all connecting points are symmetrically arranged about a two-dimensional plane perpendicular to the axis of the first coil and the second coil.

20. The electrodynamic acoustic transducer as claimed in claim 19, further comprising a spider connected to the coil arrangement, the spider comprising four spider arms extending from the coil arrangement to the housing, each spider arm being connected to a different side of the rectangular-shaped coil arrangement, wherein the connecting wires are attached to a spider arm between the connecting points and the terminals.

* * * * *